US012351929B2

(12) United States Patent
Masuda et al.

(10) Patent No.: US 12,351,929 B2
(45) Date of Patent: Jul. 8, 2025

(54) PLATING APPARATUS AND PLATING METHOD

(71) Applicant: EBARA CORPORATION, Tokyo (JP)

(72) Inventors: Yasuyuki Masuda, Tokyo (JP); Masashi Shimoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 587 days.

(21) Appl. No.: 17/608,424

(22) PCT Filed: Mar. 10, 2021

(86) PCT No.: PCT/JP2021/009476

§ 371 (c)(1),
(2) Date: Nov. 2, 2021

(87) PCT Pub. No.: WO2022/190243

PCT Pub. Date: Sep. 15, 2022

(65) Prior Publication Data

US 2023/0193501 A1 Jun. 22, 2023

(51) Int. Cl.

| | |
|---|---|
| ***C25D 17/02*** | (2006.01) |
| ***C25D 5/02*** | (2006.01) |
| ***C25D 17/00*** | (2006.01) |
| ***C25D 17/06*** | (2006.01) |
| ***C25D 21/10*** | (2006.01) |
| ***C25D 21/12*** | (2006.01) |

(52) U.S. Cl.

CPC ..... *C25D 17/02* (2013.01); *C25D 5/022* (2013.01); *C25D 17/001* (2013.01); *C25D 17/008* (2013.01); *C25D 17/06* (2013.01); *C25D 21/10* (2013.01); *C25D 21/12* (2013.01)

(58) Field of Classification Search

None

See application file for complete search history.

(56) References Cited

U.S. PATENT DOCUMENTS

| | | | | |
|---|---|---|---|---|
| 6,402,923 | B1 | 6/2002 | Mayer et al. | |
| 7,070,686 | B2 | 7/2006 | Contolini et al. | |
| 8,177,944 | B2 * | 5/2012 | Saito | C25D 17/008 205/97 |

(Continued)

FOREIGN PATENT DOCUMENTS

| | | | |
|---|---|---|---|
| CN | 102459717 | A | 5/2012 |
| JP | 2000-087299 | A | 3/2000 |

(Continued)

OTHER PUBLICATIONS

Machine translation of JP 2017-052986-A (Year: 2017).*

*Primary Examiner* — Harry D Wilkins, III
(74) *Attorney, Agent, or Firm* — BakerHostetler

(57) ABSTRACT

To improve uniformity of a plating film-thickness formed on a substrate.

A plating module 400 includes a plating tank 410 for housing a plating solution, a substrate holder 440 for holding a substrate Wf, an anode 430 housed within the plating tank 410, an anode mask 460 arranged between the substrate Wf held by the substrate holder 440 and the anode 430 and provided with an opening 466 in a center, and an ionically resistive element 450 arranged at an interval from the anode mask 460 between the substrate Wf held by the substrate holder 440 and the anode mask 460 and provided with a plurality of holes.

3 Claims, 14 Drawing Sheets

(56) References Cited

U.S. PATENT DOCUMENTS

| | | | | |
|---|---|---|---|---|
| RE45,687 | E | 9/2015 | Saito et al. | |
| 12,163,244 | B2 * | 12/2024 | Masuda | C25D 17/001 |
| 2002/0070126 | A1 * | 6/2002 | Sato | C25D 5/02 205/640 |
| 2002/0088708 | A1 * | 7/2002 | Sakaki | H01L 21/2885 257/E21.175 |
| 2010/0032310 | A1 * | 2/2010 | Reid | C25D 17/008 205/261 |
| 2012/0138471 | A1 * | 6/2012 | Mayer | C25D 21/12 204/275.1 |
| 2015/0203983 | A1 | 7/2015 | Tamari et al. | |
| 2016/0348263 | A1 * | 12/2016 | Woodruff | C25D 17/002 |
| 2018/0057955 | A1 * | 3/2018 | He | C25D 17/001 |
| 2024/0183059 | A1 * | 6/2024 | Masuda | C25D 21/10 |

FOREIGN PATENT DOCUMENTS

| | | | | |
|---|---|---|---|---|
| JP | 2004-363422 | A | | 12/2004 |
| JP | 2017052986 | A | * | 3/2017 |
| JP | 2017-075405 | A | | 4/2017 |
| JP | 2020-176303 | A | | 10/2020 |
| KR | 10-1515120 | B1 | | 4/2015 |
| WO | WO 2010/144330 | A2 | | 12/2010 |

* cited by examiner

1000

PLATING APPARATUS AND PLATING METHOD

TECHNICAL FIELD

This application relates to a plating apparatus and a plating method.

BACKGROUND ART

There has been known a cup type electroplating device as an exemplary plating apparatus. The cup type electroplating device immerses a substrate (for example, a semiconductor wafer) held by a substrate holder with a surface to be plated facing downward in a plating solution and applies a voltage between the substrate and an anode, thereby depositing a conductive film on the surface of the substrate.

For example, PTL 1 discloses that, in a cup type electroplating device, a ring-shaped shield having an opening formed at the center is arranged between a substrate and an anode. PTL 1 also discloses that a plating film-thickness formed on the substrate is uniformized by adjusting a size of the opening of the shield and by adjusting a distance between the shield and the substrate.

CITATION LIST

Patent Literature

PTL 1: U.S. Pat. No. 6,402,923 B1

SUMMARY OF INVENTION

Technical Problem

However, there is a room for improvements in the prior art in improving the uniformity of the plating film-thickness formed on the substrate.

That is, the prior art is to uniformize the plating film-thickness formed on the substrate by adjusting the size of the opening of the shield and by adjusting the distance between the shield and the substrate. However, it is sometimes difficult to sufficiently uniformize the plating film-thickness on an outer circumference portion of the substrate just by adjusting the size of the opening of the shield and the like. Accordingly, a technique for uniformizing the plating film-thickness of the entire substrate including the outer circumference portion of the substrate is required.

Therefore, this application has one object to improve uniformity of a plating film-thickness formed on a substrate.

Solution to Problem

According to one embodiment, there is disclosed a plating apparatus including a plating tank, a substrate holder, an anode, an anode mask, and an ionically resistive element. The plating tank is for housing a plating solution. The substrate holder is for holding a substrate. The anode is housed within the plating tank. The anode mask is arranged between the substrate held by the substrate holder and the anode. The anode mask is provided with an opening in a center of the anode mask. The ionically resistive element is arranged at an interval from the anode mask between the substrate held by the substrate holder and the anode mask. The ionically resistive element is provided with a plurality of holes.

DESCRIPTION OF EMBODIMENTS

Figure 1:
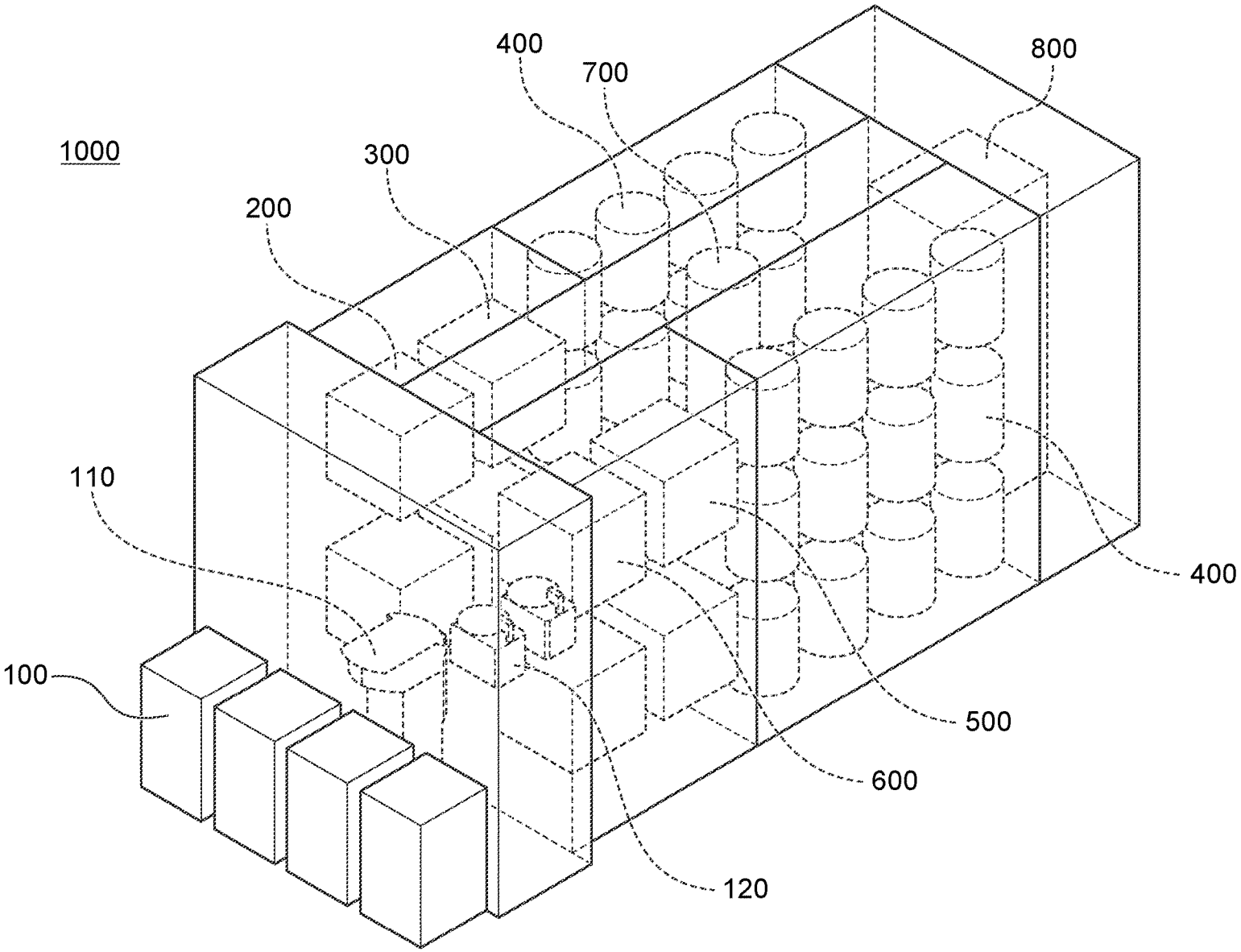
FIG. 1 is a perspective view illustrating an overall configuration of a plating apparatus of this embodiment.

The following describes embodiments of the present invention with reference to the drawings. In the drawings described below, identical reference numerals are attached to identical or similar components, and overlapping descriptions are omitted.

<Overall Configuration of Plating Apparatus>

Figure 2:
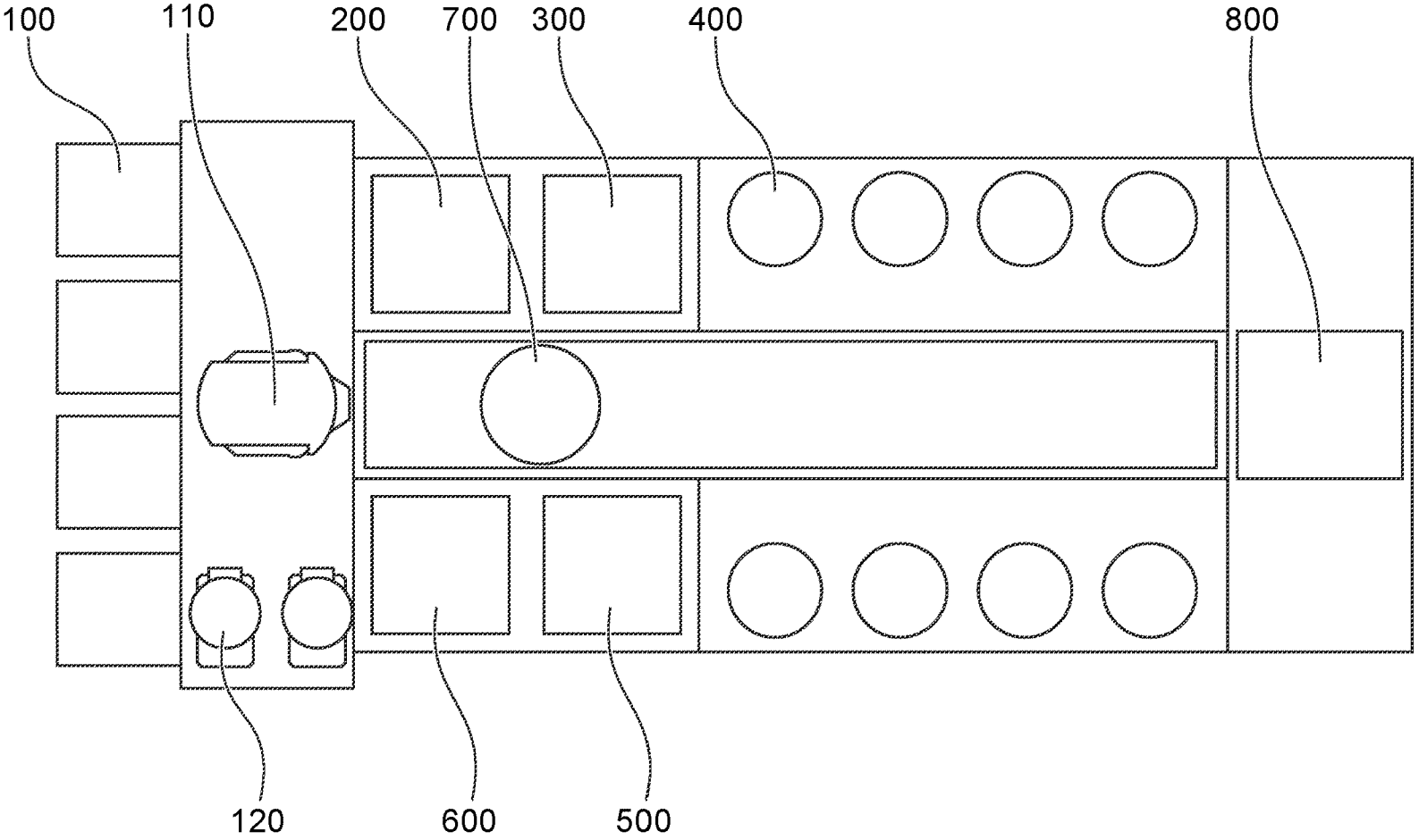
FIG. 2 is a plan view illustrating the overall configuration of the plating apparatus of this embodiment.

FIG. 1 is a perspective view illustrating an overall configuration of a plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

<Configuration of Plating Module>

Figure 3:
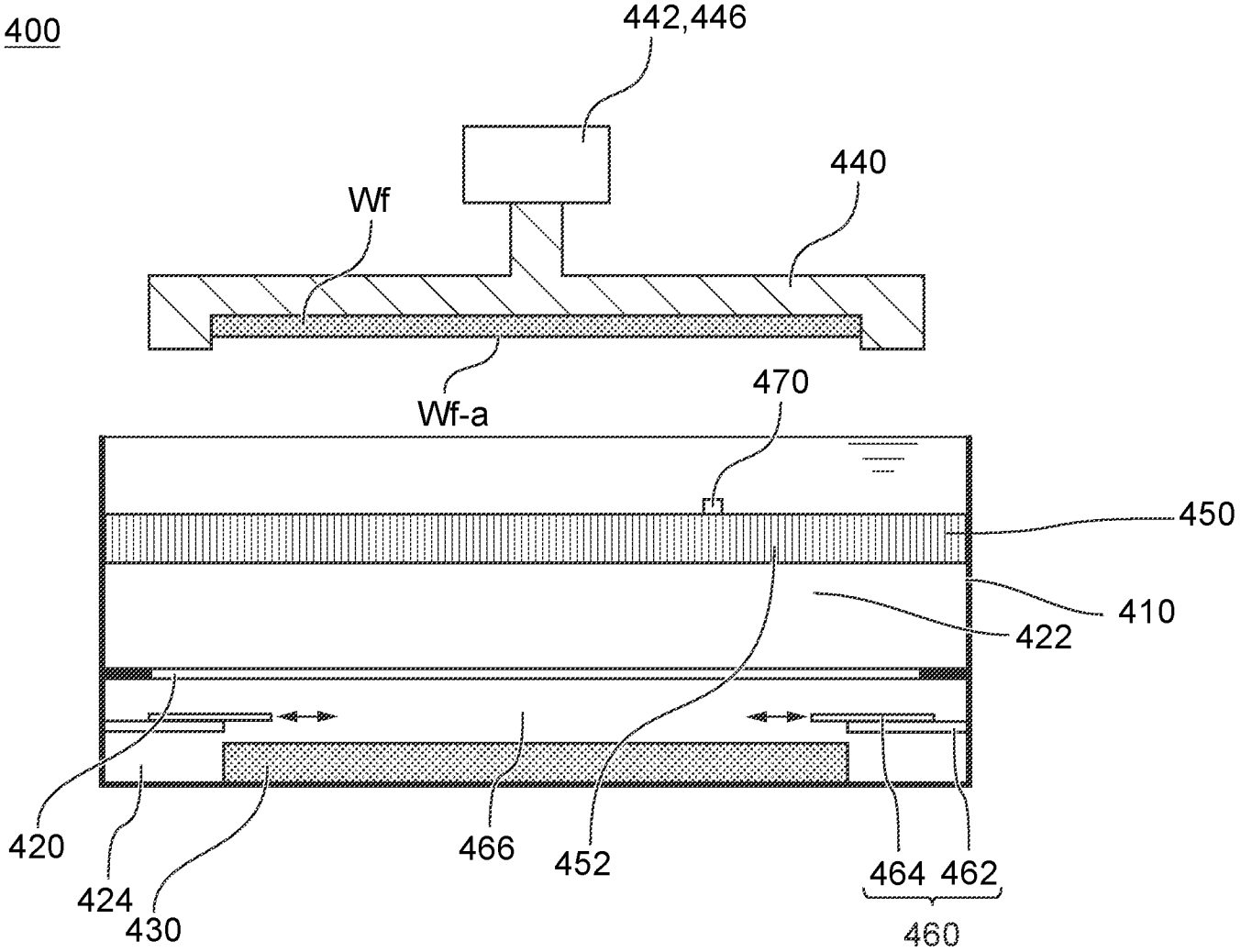
FIG. 3 is a vertical cross-sectional view generally illustrating a configuration of a plating module of one embodiment.

Next, a configuration of the plating module 400 will be described. The 24 plating modules 400 in this embodiment have identical configurations, and therefore, only one plating module 400 will be described. Note that while this embodiment describes a cup type plating module that performs the plating process by immersing the substrate with the surface to be plated facing downward in the plating solution as one example, the plating module is not limited to the cup type. For example, the plating module may be configured to perform the plating process on the substrate with the surface to be plated facing toward an arbitrary direction, such as sideways or upward. FIG. 3 is a vertical cross-sectional view generally illustrating a configuration of the plating module 400 of one embodiment. As illustrated in FIG. 3, the plating module 400 includes a plating tank 410 for housing the plating solution. The plating module 400 includes a membrane 420 that separates the inside of the plating tank 410 in the vertical direction. The membrane 420 is, for example, configured of a thin film having elasticity. The inside of the plating tank 410 is divided by the membrane 420 into a cathode region 422 in which a substrate Wf is immersed and an anode region 424 in which the anode is arranged. The cathode region 422 and the anode region 424 are each filled with the plating solution. The plating module 400 includes an anode 430 arranged on a bottom surface of the plating tank 410 in the anode region 424.

The plating module 400 includes a substrate holder 440 for holding the substrate Wf with a surface to be plated Wf-a facing downward. The substrate holder 440 includes a power feeding contact point for power feeding the substrate Wf from a power source (not illustrated). In one embodiment, the power feeding contact point is in contact with an outer circumference portion of the substrate Wf to power feed the outer circumference portion of the substrate Wf. The plating module 400 includes a distance adjustment mechanism 442 for adjusting a distance between the substrate holder 440 and an ionically resistive element 450 described later. In this embodiment, the distance adjustment mechanism 442 is achieved by a holder elevating mechanism that moves the substrate holder 440 up and down for adjusting a position of the substrate holder 440 with respect to the ionically resistive element 450. The distance adjustment mechanism (the holder elevating mechanism) 442 can be achieved by a known mechanism, such as a motor. The plating module 400 is configured to perform the plating process on the surface to be plated Wf-a of the substrate Wf by immersing the substrate Wf in the plating solution in the cathode region 422 using the distance adjustment mechanism (the holder elevating mechanism) 442 and applying a voltage between the anode 430 and the substrate Wf. Note that the distance adjustment mechanism 442 is not limited to the configuration that adjusts the distance between the substrate holder 440 and the ionically resistive element 450 by the up and down movement of the substrate holder 440 by the holder elevating mechanism. For example, the distance adjustment mechanism 442 may include an ionically resistive element elevating mechanism that moves the ionically resistive element 450 up and down for adjusting a position of the ionically resistive element 450 with respect to the substrate holder 440, instead of the holder elevating mechanism. The distance adjustment mechanism 442 may include both the holder elevating mechanism and the ionically resistive element elevating mechanism.

The plating module 400 includes a rotation mechanism 446 for rotating the substrate holder 440 such that the substrate Wf rotates about a virtual rotation axis perpendicularly extending in the center of the surface to be plated Wf-a. The rotation mechanism 446 can be achieved by a known mechanism, such as a motor.

Figure 4:
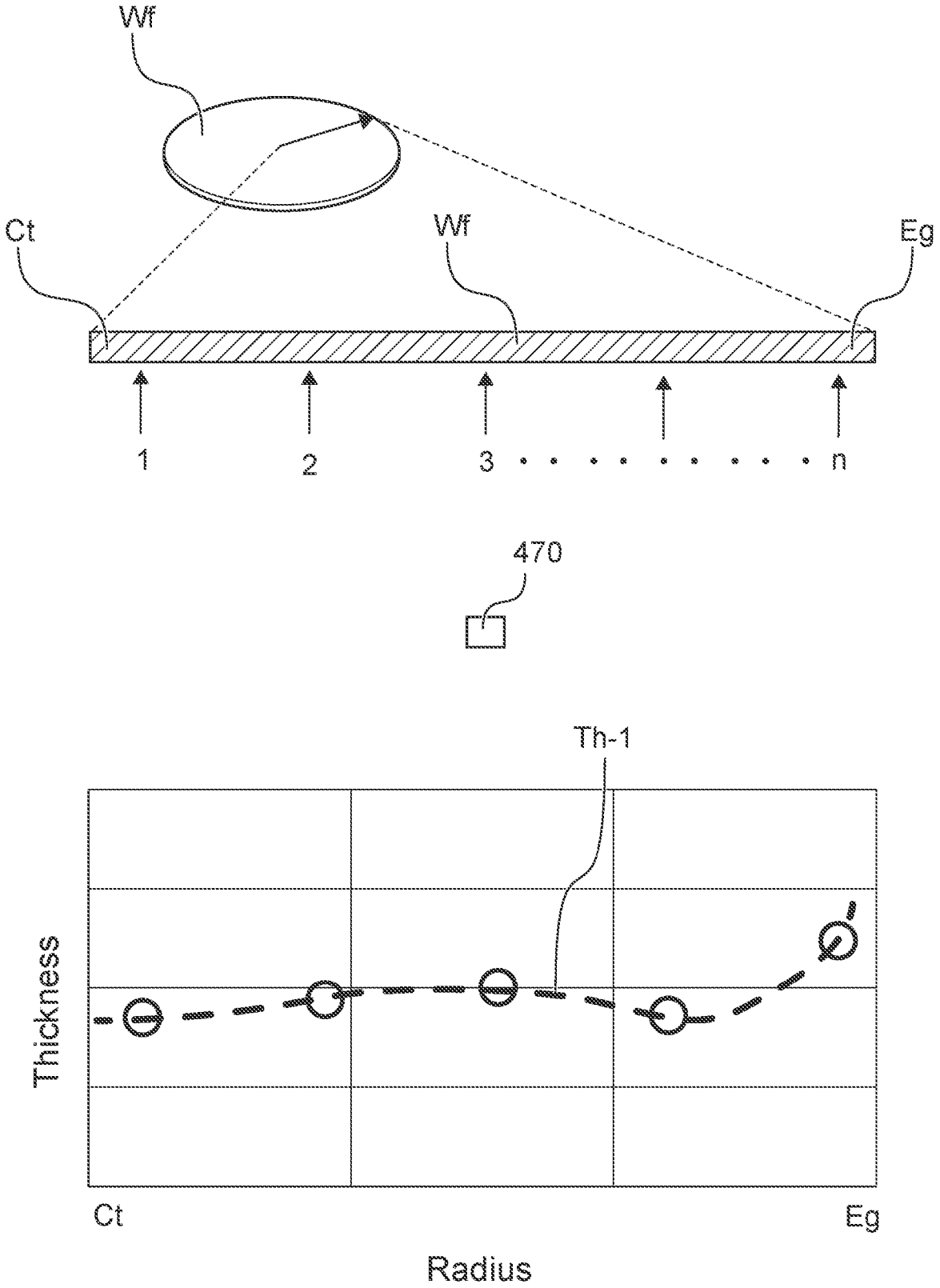
FIG. 4 is a drawing schematically illustrating measurement of a plating film-thickness distribution by a sensor.

The plating module 400 includes a sensor 470 that can measure a plating film-thickness distribution or a current density distribution along the radial direction of the surface to be plated Wf-a of the substrate Wf. FIG. 4 is a drawing schematically illustrating the measurement of the plating film-thickness distribution by the sensor. As illustrated in FIG. 4, the sensor 470 of one embodiment is configured to measure plating film-thicknesses or current densities at a plurality of monitoring points (n monitoring points in one embodiment) that present in the radial direction toward an outer circumference portion Eg from a center portion Ct of the substrate Wf. The sensor 470 obtains information on the plating film-thickness, the current density, or the like at the plurality of monitoring points using an arbitrary method, such as optics, electric field, magnetic field, and electric potential, at a constant time interval during the plating process. The plating module 400 is configured to obtain a plating film-thickness distribution Th-1 in the radial direction of the surface to be plated Wf-a of the substrate Wf based on the information obtained by the sensor 470. Note that, while in one embodiment, the sensor 470 is arranged on the ionically resistive element 450 described later, the arrangement location of the sensor 470 is arbitrary.

As illustrated in FIG. 3, the plating module 400 includes an anode mask 460 arranged between the substrate Wf held by the substrate holder 440 and the anode 430. The anode mask 460 is arranged at the proximity of the anode 430 in the anode region 424. The anode mask 460 is a ring-shaped electric field barrier having an opening 466 formed at the center.

Figure 5:
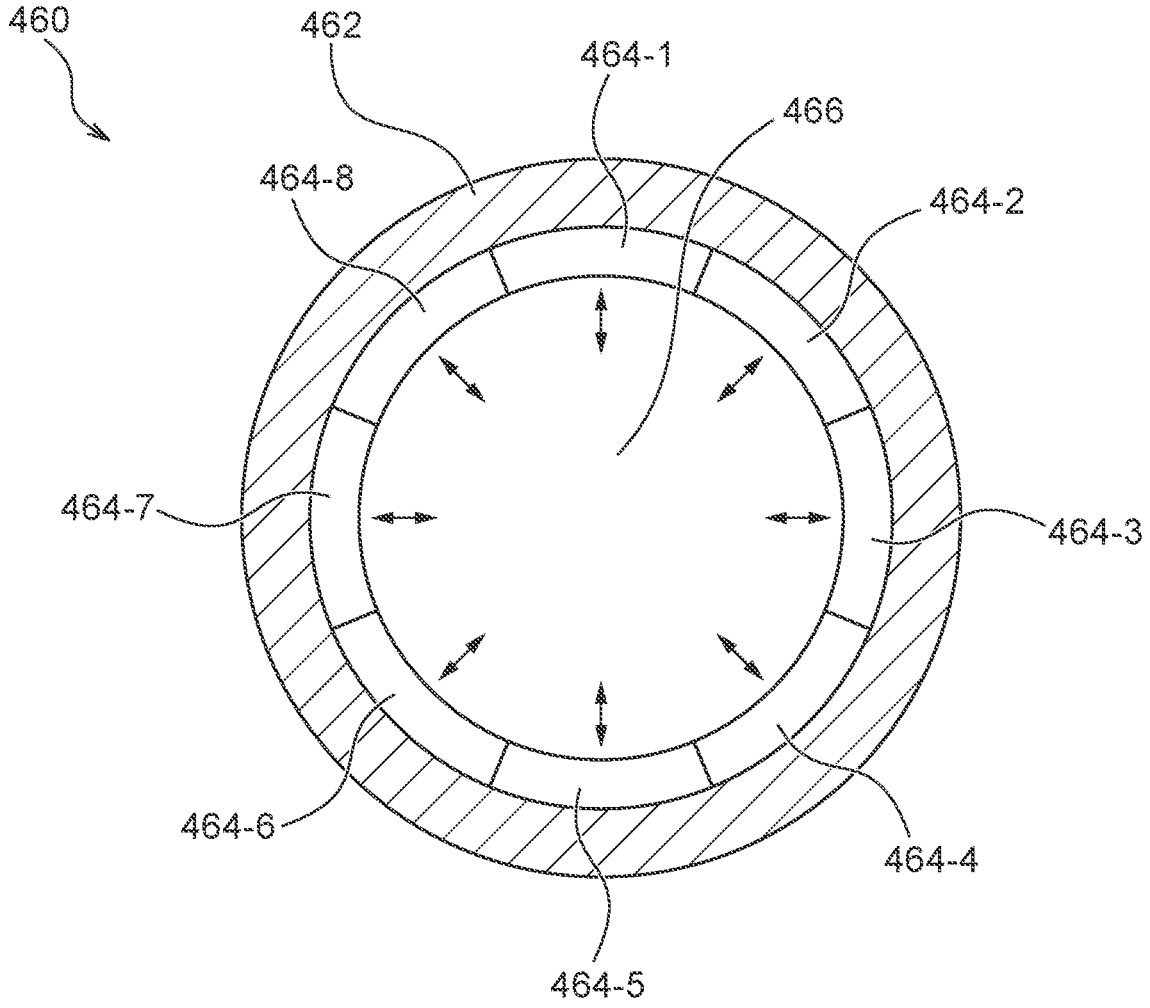
FIG. 5 is a plan view schematically illustrating an anode mask.

FIG. 5 is a plan view schematically illustrating the anode mask. As illustrated in FIGS. 3 and 5, the anode mask 460 includes a first anode mask 462 in a ring shape secured to an inner sidewall of the plating tank 410 and a plurality of second anode masks 464 arranged along the circumferential direction on the first anode mask 462. While in one embodiment, the second anode masks 464 are configured by including eight second anode masks 464-1 to 464-8, the number of the second anode masks 464 is arbitrary. The plurality of second anode masks 464 are each configured to be movable along the radial direction of the first anode mask 462.

The anode mask 460 can decrease a diameter of the opening 466 of the anode mask 460 by moving the plurality of second anode masks 464 to the inside in the radial direction of the first anode mask 462. On the other hand, the anode mask 460 can increase the diameter of the opening 466 of the anode mask 460 by moving the plurality of second anode masks 464 to the outside in the radial direction of the first anode mask 462. By changing the diameter of the opening 466, the anode mask 460 acts to substantially change the diameter of the anode 430. As a result, the anode mask 460 acts to change the film-thickness distribution of the entire body from the center of the substrate Wf to the outer circumference portion by changing the diameter of the opening 466. This respect will be described below.

Figure 6:
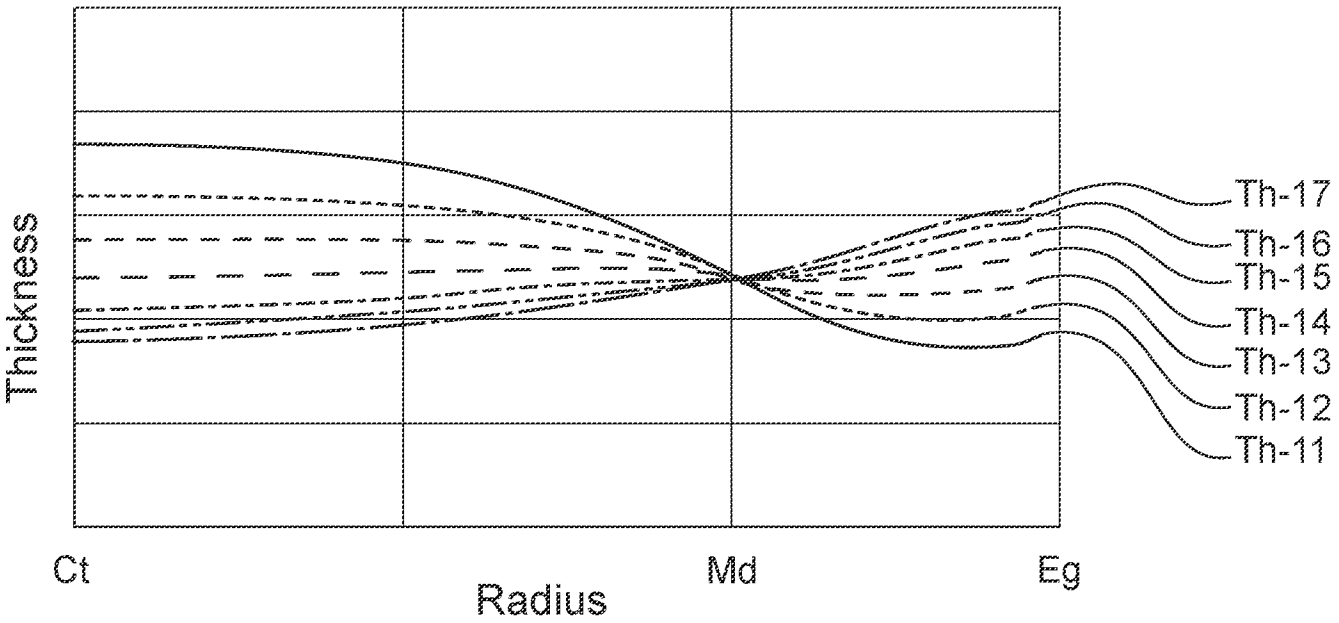
FIG. 6 is a drawing schematically illustrating a plating film-thickness distribution when a diameter of an opening of the anode mask is changed.

FIG. 6 is a drawing schematically illustrating the plating film-thickness distribution when the diameter of the opening of the anode mask is changed. In FIG. 6, the vertical axis indicates the plating film-thickness and the horizontal axis indicates a radius position from the center portion Ct to the outer circumference portion Eg of the surface to be plated Wf-a of the substrate Wf. In FIG. 6, plating film-thickness distributions Th-11 to Th-17 indicate plating film-thickness distributions in an order when the diameter of the opening 466 of the anode mask 460 is increased.

As illustrated in FIG. 6, when the diameter of the opening 466 of the anode mask 460 is changed, the plating film-thickness from the center portion Ct to the outer circumference portion Eg of the substrate Wf changes. Specifically, when the diameter of the opening 466 of the anode mask 460 is small, the electric field concentrates in the proximity of the center portion Ct of the substrate Wf, and therefore, the plating film-thickness of the center portion Ct of the substrate Wf increases and the plating film-thickness of the outer circumference portion Eg of the substrate Wf decreases like, for example, the plating film-thickness distribution Th-11. On the other hand, when the diameter of the opening 466 of the anode mask 460 is large, the electric field concentrates in the outer circumference portion Eg of the substrate Wf, and therefore, the plating film-thickness of the center portion Ct of the substrate Wf decreases and the plating film-thickness of the outer circumference portion Eg of the substrate Wf increases like, for example, the plating film-thickness distribution Th-17. In the example of FIG. 6, in the case of the plating film-thickness distribution Th-14, the plating film-thickness distribution becomes the most uniform. However, the plating film-thickness distribution is more or less non-uniform at the proximity of the outer circumference portion Eg of the substrate Wf, and therefore, uniformization of the plating film-thickness at the proximity of the outer circumference portion Eg of the substrate Wf is required.

In this respect, as illustrated in FIG. 3, the plating module 400 in one embodiment includes the ionically resistive element 450 arranged at an interval from the anode mask 460 between the substrate Wf held by the substrate holder 440 and the anode mask 460. The ionically resistive element 450 is arranged in the cathode region 422. The ionically resistive element 450 is configured of a plate-shaped member (a punching plate) in which a plurality of through-holes 452 passing through the anode region 424 and the cathode region 422 are formed in one embodiment. However, the shape of the ionically resistive element 450 is arbitrary. The ionically resistive element 450 is not limited to the punching plate, and can be configured of a porous body, such as a ceramic material in which many pores are formed.

The ionically resistive element 450 acts as an ionically resistive element between the anode 430 and the substrate Wf. While the ionically resistive element 450 has resistivity of, for example, 1 Ω·m or more, preferably 3 Ω·m or more, this should not be construed in a limiting sense and the resistivity of the ionically resistive element 450 is arbitrary. Arranging the ionically resistive element 450 increases a resistance value between the anode 430 and the substrate Wf, and therefore, the electric field is less likely to expand. As a result, the plating film-thickness distribution formed on the surface to be plated Wf-a of the substrate Wf can be uniformized.

The ionically resistive element 450 particularly affects the plating film-thickness distribution in the outer circumference portion of the surface to be plated Wf-a of the substrate Wf. That is, the distance adjustment mechanism 442 is configured to adjust the distance between the substrate holder 440 and the ionically resistive element 450 based on the plating film-thickness distribution or the current density distribution measured by the sensor 470. Specifically, the distance adjustment mechanism (the holder elevating mechanism) 442 is configured to move the substrate holder 440 up and down based on the plating film-thickness distribution or the current density distribution measured by the sensor 470. Moving the substrate holder 440 up and down changes the distance between the substrate Wf and the ionically resistive element 450.

Figure 7:
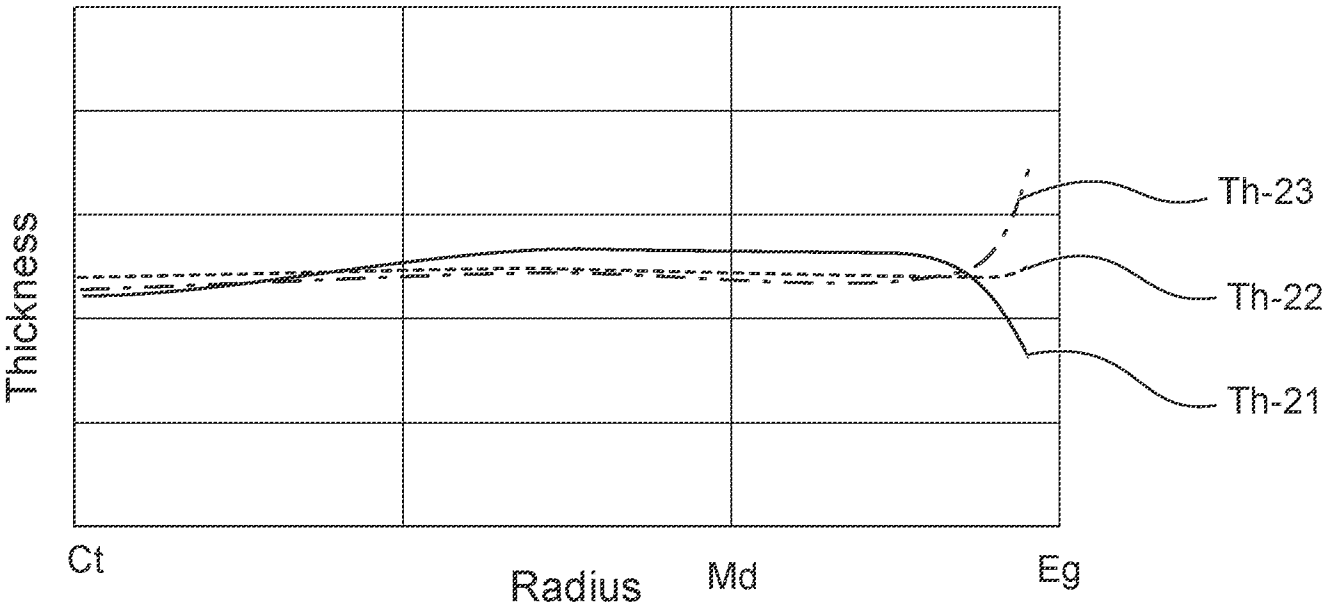
FIG. 7 is a drawing schematically illustrating a plating film-thickness distribution when a distance between a substrate and an ionically resistive element is changed.

FIG. 7 is a drawing schematically illustrating the plating film-thickness distribution when the distance between the substrate and the ionically resistive element is changed. In FIG. 7, the vertical axis indicates the plating film-thickness and the horizontal axis indicates the radius position from the center portion Ct to the outer circumference portion Eg of the surface to be plated Wf-a of the substrate Wf. In FIG. 7, plating film-thickness distributions Th-21, Th-22, and Th-23 indicate plating film-thickness distributions in an order when the distance between the substrate Wf and the ionically resistive element 450 is increased. As illustrated in FIG. 7, when the distance between the substrate Wf and the ionically resistive element 450 is changed, the plating film-thickness at the proximity of the outer circumference portion Eg of the substrate Wf significantly changes. This respect will be described below.

Figure 8:
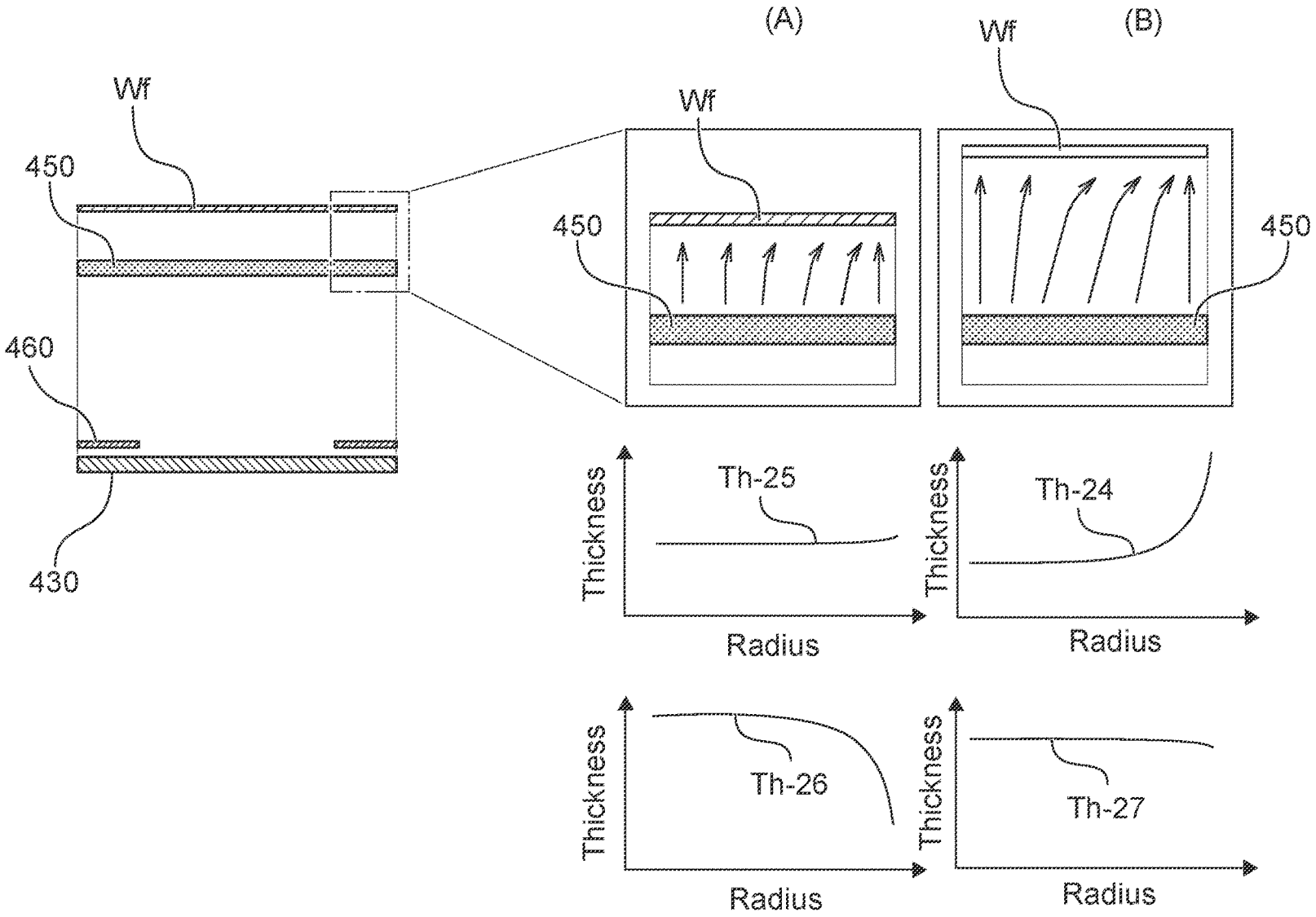
FIG. 8 is a drawing schematically illustrating a plating film-thickness distribution on an outer circumference portion of the substrate when the distance between the substrate and the ionically resistive element is changed.

FIG. 8 is a drawing schematically illustrating the plating film-thickness distribution in the outer circumference portion of the substrate when the distance between the substrate and the ionically resistive element is changed. FIG. 8A illustrates a plating film-thickness distribution when the distance between the substrate Wf and the ionically resistive element 450 is narrowed, and FIG. 8B illustrates a plating film-thickness distribution when the distance between the substrate Wf and the ionically resistive element 450 is widened. As illustrated in FIG. 8, when the distance between the substrate Wf and the ionically resistive element 450 is increased, a space in which the electric field can expand increases. Since the power feeding contact point of the substrate holder 440 is in contact with the outer circumference portion of the substrate Wf, the electric field relatively concentrates in the outer circumference portion of the substrate Wf to thicken the plating film-thickness in the outer circumference portion.

The plating module 400 uses this property and can adjust the plating film-thickness in the outer circumference portion of the substrate Wf by the distance adjustment mechanism 442. For example, when the plating film-thickness distribution in the outer circumference portion of the substrate Wf is non-uniform like the plating film-thickness distribution Th-24, the distance adjustment mechanism (the holder elevating mechanism) 442 can adjust the plating film-thickness distribution to a uniform plating film-thickness distribution like the plating film-thickness distribution Th-25 by decreasing the distance between the substrate Wf and the ionically resistive element 450 (lowering the substrate holder 440). On the other hand, for example, when the plating film-thickness distribution in the outer circumference portion of the substrate Wf is non-uniform like the plating film-thickness distribution Th-26, the distance adjustment mechanism (the holder elevating mechanism) 442 can adjust the plating film-thickness distribution to a uniform plating film-thickness distribution like the plating film-thickness distribution Th-27 by increasing the distance between the substrate Wf and the ionically resistive element 450 (elevating the substrate holder 440). Note that how the plating film-thickness distribution will be provided is determined by a size of the opening 466 of the anode mask 460, a type of the plating solution, a current density on the surface to be plated Wf-a, and the like.

As described above, the plating module 400 of one embodiment includes both the anode mask 460 and the ionically resistive element 450. Accordingly, the plating module 400 can improve the uniformity of the plating film-thickness distribution of the entire substrate Wf using the respective properties of the anode mask 460 and the ionically resistive element 450. For example, the plating module 400 measures the plating film-thickness distribution or the current density distribution along the radial direction of the surface to be plated Wf-a of the substrate Wf using the sensor 470 while the plating process is performed on the substrate Wf.

Subsequently, the plating module 400 adjusts a size of the diameter of the opening 466 of the anode mask 460 based on the plating film-thickness distribution or the current density distribution measured by the sensor 470. Specifically, the size of the diameter of the opening 466 of the anode mask 460 is adjusted such that a difference in plating film-thickness or current density between the center portion Ct of the surface to be plated Wf-a illustrated in FIG. 6 and a midpoint Md between the center portion Ct and the outer circumference portion Eg of the surface to be plated Wf-a is decreased. This improves the uniformity of the plating film-thickness between the center portion Ct and the midpoint Md of the surface to be plated Wf-a of the substrate Wf.

On the other hand, the plating module 400 adjusts the distance between the substrate Wf and the ionically resistive element 450 by moving the substrate holder 440 up and down based on the plating film-thickness distribution or the current density distribution measured by the sensor 470. Specifically, the substrate holder 440 is moved up and down such that a difference in plating film-thickness or current density between the midpoint Md between the center portion Ct and the outer circumference portion Eg of the surface to be plated Wf-a illustrated in FIG. 7 and the outer circumference portion Eg of the surface to be plated Wf-a is decreased. This improves the uniformity of the plating film-thickness between the midpoint Md and the outer circumference portion Eg of the surface to be plated Wf-a of the substrate Wf.

As described above, the plating module 400 adjusts the diameter of the opening 466 of the anode mask 460 and adjusts the distance between the substrate Wf and the ionically resistive element 450 while performing the plating process, thereby ensuring the improved uniformity of the plating film-thickness distribution of the surface to be plated Wf-a of the substrate Wf. Note that, while one embodiment has described the example of adjusting the diameter of the opening 466 of the anode mask 460 and adjusting the distance between the substrate Wf and the ionically resistive element 450 while performing the plating process, this should not be construed in a limiting sense. For example, when optimal values of the diameter of the opening 466 of the anode mask 460 and the distance between the substrate Wf and the ionically resistive element 450 are obtained in advance and they are set as the optimal values, the diameter of the opening 466 of the anode mask 460 and the up and down movement of the substrate holder 440 are not necessarily adjusted during the plating process.

Figure 9:
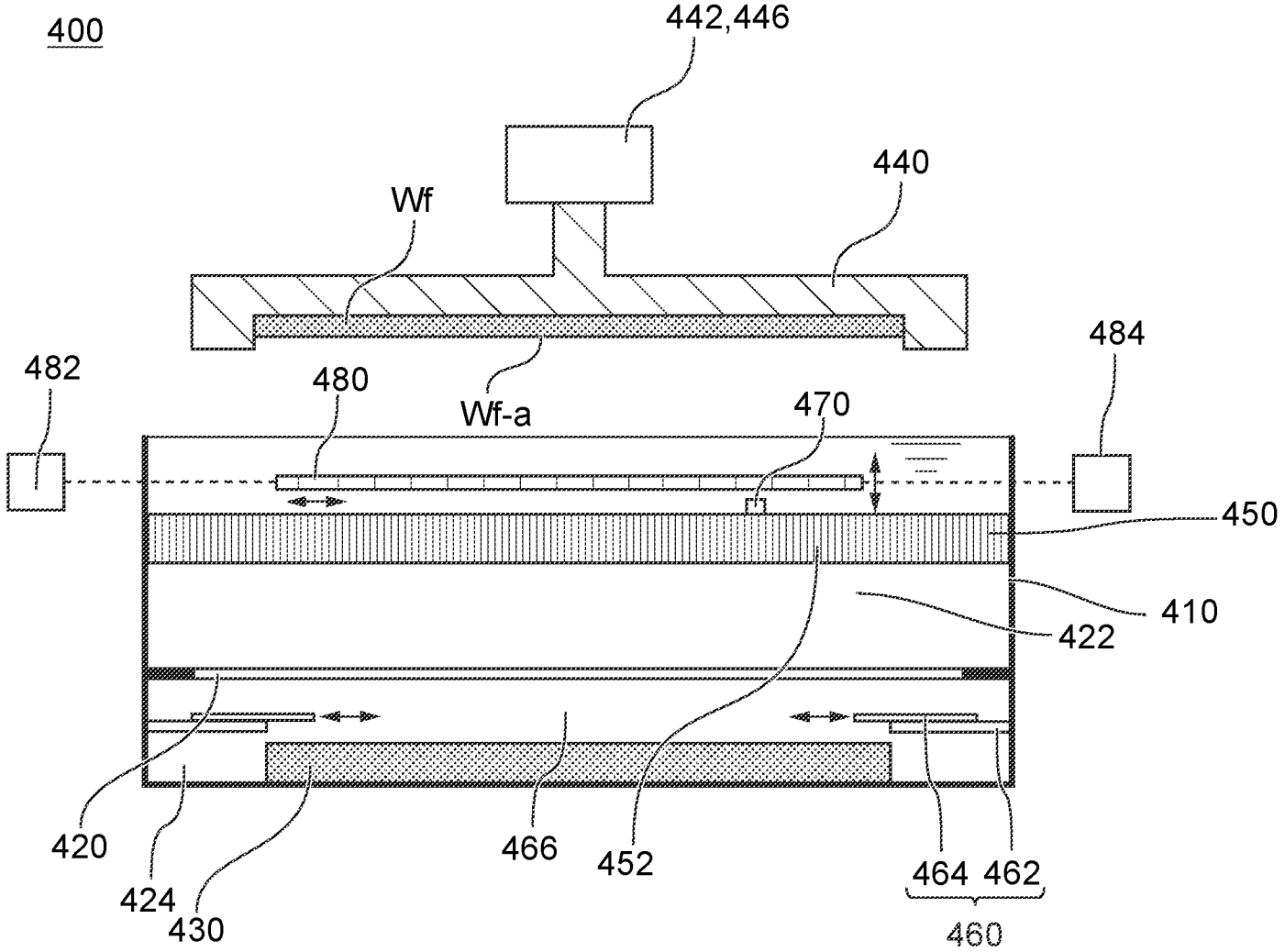
FIG. 9 is a vertical cross-sectional view generally illustrating a configuration of a plating module of one embodiment.

Next, another embodiment of the plating module 400 will be described. FIG. 9 is a vertical cross-sectional view generally illustrating a configuration of the plating module of one embodiment. The embodiment in FIG. 9 has a configuration similar to that of the embodiment illustrated in FIG. 3 except that it includes a paddle, a paddle stirring mechanism, and the like. Accordingly, the description overlapping with the embodiment illustrated in FIG. 3 is omitted.

As illustrated in FIG. 9, the plating module 400 includes a paddle 480 arranged between the substrate Wf held by the substrate holder 440 and the ionically resistive element 450 and a paddle stirring mechanism 482 for stirring the paddle 480 in the plating solution. The paddle stirring mechanism 482 is configured to stir the plating solution by reciprocating the paddle 480 in a parallel manner to the surface to be plated Wf-a of the substrate Wf.

Here, when the substrate holder 440 is moved up and down (a height of the substrate holder 440 is changed) for changing the distance between the substrate Wf and the ionically resistive element 450 during the plating process as the embodiment described above, a distance between the paddle 480 and the substrate Wf is also simultaneously changed. Then, a stirring intensity of the plating solution on the surface to be plated Wf-a of the substrate Wf is also changed to possibly affect the uniformity of the plating film-thickness distribution on the surface to be plated Wf-a. This respect will be described below.

Figure 10:
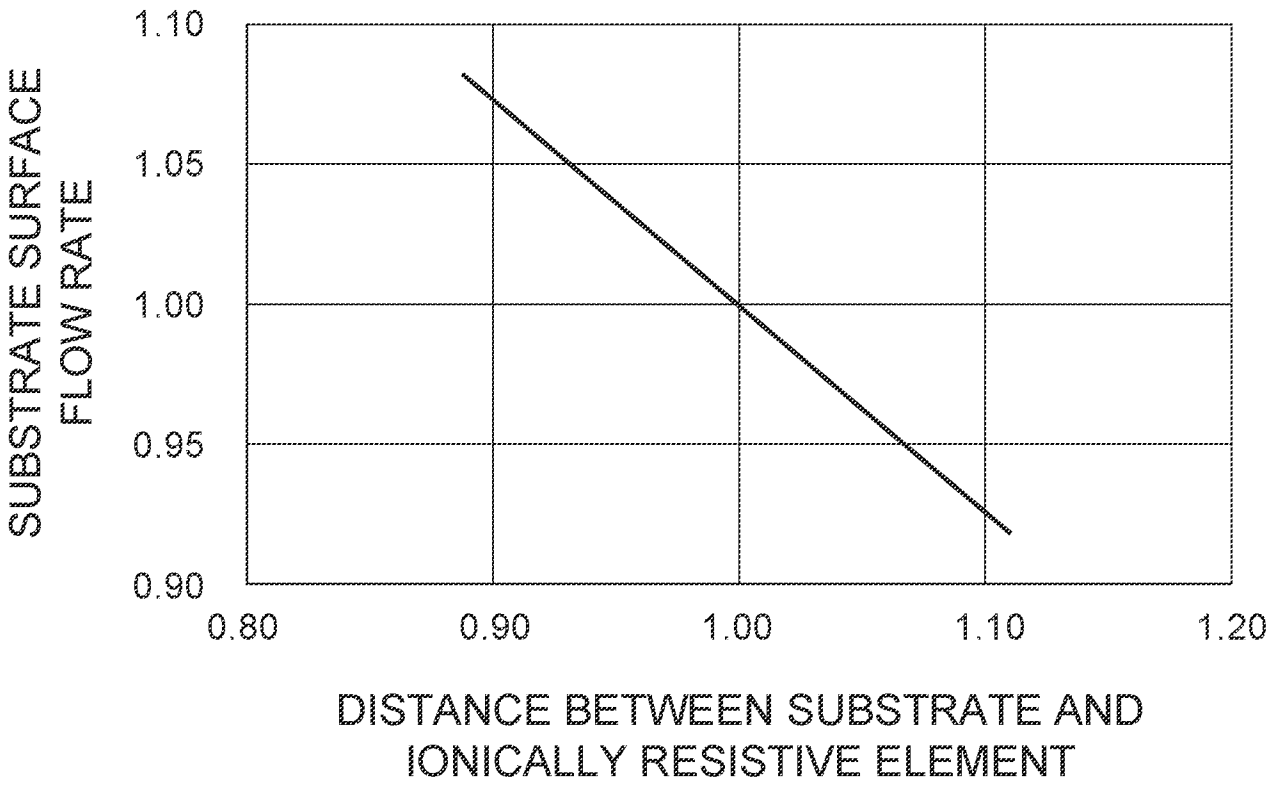
FIG. 10 is a drawing illustrating a flow rate of a plating solution on a surface to be plated when the distance between the substrate and the ionically resistive element is changed.

FIG. 10 is a drawing illustrating a flow rate of the plating solution on the surface to be plated when the distance between the substrate and the ionically resistive element is changed. In FIG. 10, the vertical axis indicates the flow rate of the plating solution on the surface to be plated Wf-a and the horizontal axis indicates the distance between the substrate Wf and the ionically resistive element 450. As illustrated in FIG. 10, when the distance between the substrate Wf and the ionically resistive element 450 is changed by approximately 10%, the flow rate of the plating solution on the surface to be plated Wf-a is changed by approximately 8%. When the flow rate of the plating solution on the surface to be plated Wf-a is changed, the uniformity of the plating film-thickness distribution is possibly affected.

In contrast to this, the plating module 400 of one embodiment includes a paddle position adjustment mechanism 484 that moves the paddle 480 up and down for adjusting the position of the paddle 480 as illustrated in FIG. 9. The paddle position adjustment mechanism 484 is configured to adjust (move up and down) the position of the paddle 480 in synchronization with the position adjustment (the up and down movement) of the substrate holder 440 by the distance adjustment mechanism (the holder elevating mechanism) 442 during the plating process. According to one embodiment, moving the paddle 480 up and down in synchronization with the up and down movement of the substrate holder 440 during the plating process ensures maintaining the distance between the paddle 480 and the substrate Wf constant. As a result, with the plating module 400 in one embodiment, even when the height of the substrate holder 440 is changed during the plating process, the flow rate of the plating solution on the surface to be plated Wf-a can be maintained constant, thereby ensuring the improved uniformity of the plating film-thickness distribution.

Figure 11:
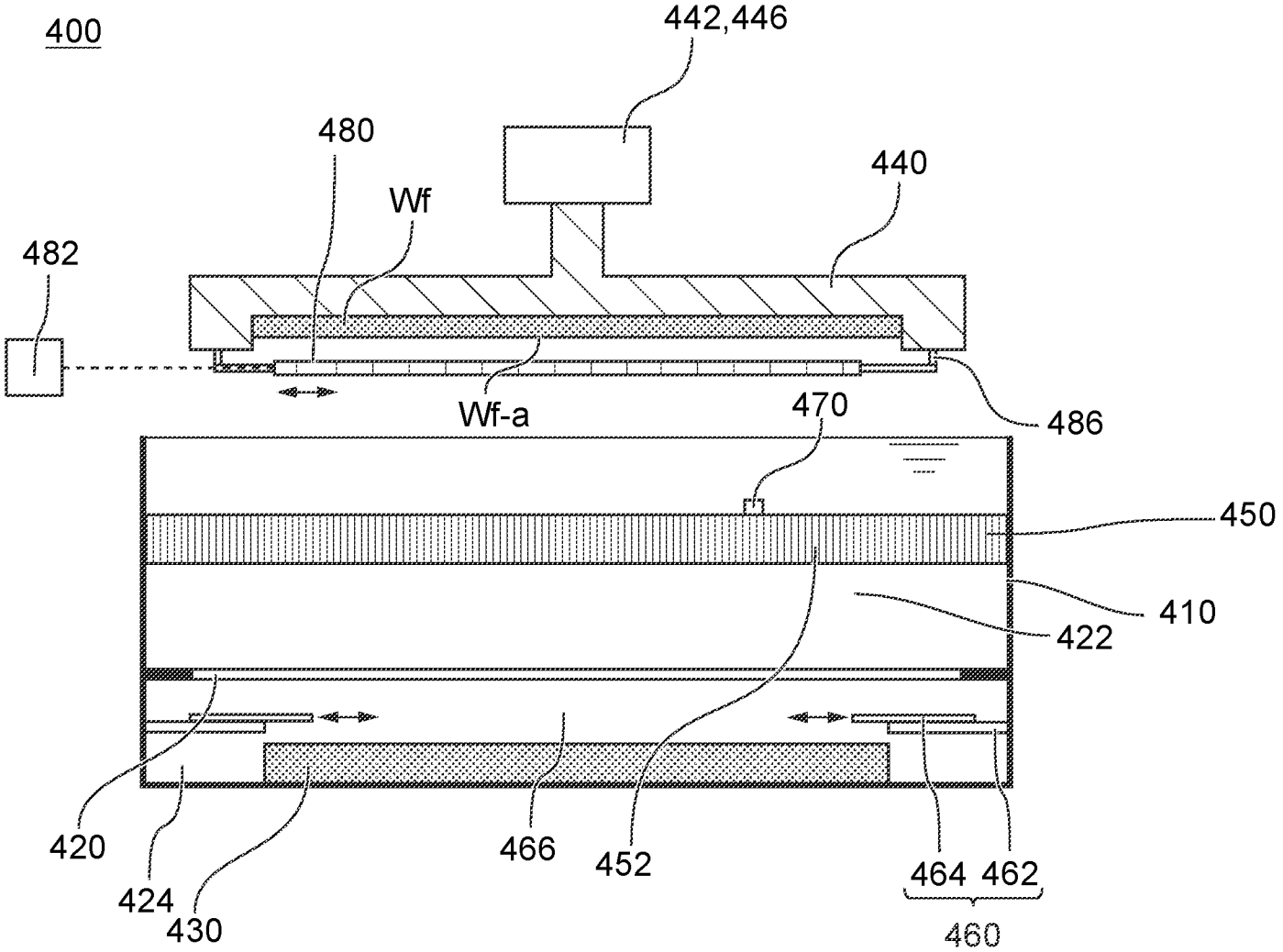
FIG. 11 is a vertical cross-sectional view generally illustrating a configuration of a plating module of one embodiment.

Next, another embodiment of the plating module 400 will be described. FIG. 11 is a vertical cross-sectional view schematically illustrating a configuration of a plating module of one embodiment. The embodiment in FIG. 11 has a configuration similar to that of the embodiment illustrated in FIG. 3 except that it includes a paddle, a paddle stirring mechanism, and the like. Accordingly, the description overlapping with the embodiment illustrated in FIG. 3 is omitted.

As illustrated in FIG. 11, the plating module 400 includes the paddle 480 arranged between the substrate Wf held by the substrate holder 440 and the ionically resistive element 450 and the paddle stirring mechanism 482 for stirring the paddle 480 in the plating solution. The paddle stirring mechanism 482 is configured to stir the plating solution by reciprocating the paddle 480 in a parallel manner to the surface to be plated Wf-a of the substrate Wf.

As illustrated in FIG. 11, the paddle 480 is secured to the substrate holder 440 by a paddle support mechanism 486. Accordingly, the paddle 480 moves up and down in conjunction with the up and down movement of the substrate holder 440, and therefore, the distance between the substrate Wf and the paddle 480 is constant. As a result, with the plating module 400 of one embodiment, even when the height of the substrate holder 440 is changed during the plating process, the flow rate of the plating solution on the surface to be plated Wf-a can be maintained constant, thereby ensuring the improved uniformity of the plating film-thickness distribution.

Figure 12:
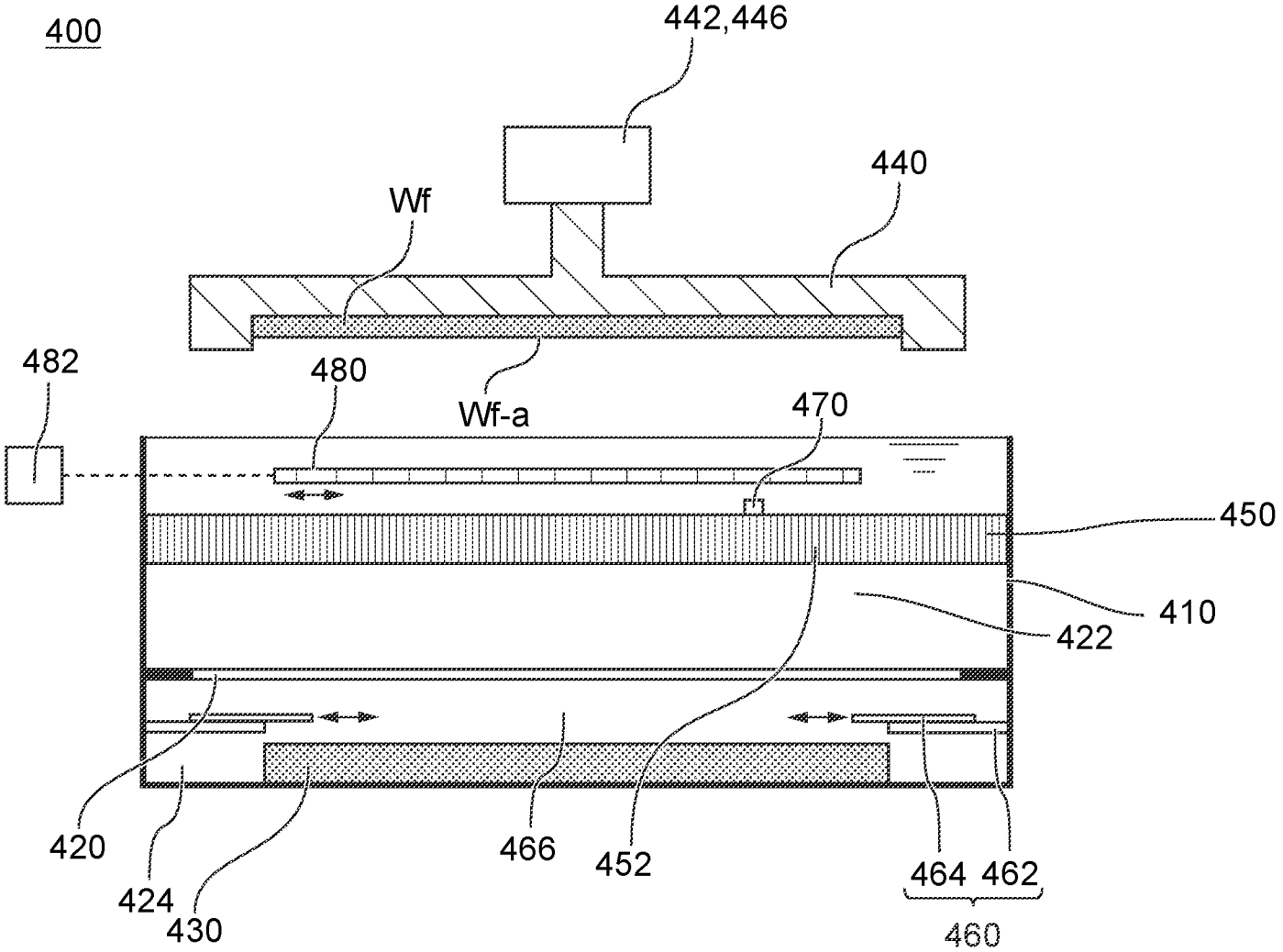
FIG. 12 is a vertical cross-sectional view generally illustrating a configuration of a plating module of one embodiment.

Next, another embodiment of the plating module 400 will be described. FIG. 12 is a vertical cross-sectional view generally illustrating a configuration of a plating module of one embodiment. The embodiment in FIG. 12 has a configuration similar to that of the embodiment illustrated in FIG. 3 except that it includes a paddle, a paddle stirring mechanism, and the like. Accordingly, the description overlapping with the embodiment illustrated in FIG. 3 is omitted.

As illustrated in FIG. 12, the plating module 400 includes the paddle 480 arranged between the substrate Wf held by the substrate holder 440 and the ionically resistive element 450 and the paddle stirring mechanism 482 for stirring the paddle 480 in the plating solution. The paddle stirring mechanism 482 is configured to stir the plating solution by reciprocating the paddle 480 in a parallel manner to the surface to be plated Wf-a of the substrate Wf.

In one embodiment, the paddle stirring mechanism 482 is configured to adjust a stirring speed of the paddle 480 according to the position adjustment (the up and down movement) of the substrate holder 440 by the distance adjustment mechanism (the holder elevating mechanism) 442. More specifically, the paddle stirring mechanism 482 is configured to adjust the stirring speed of the paddle 480 such that the flow rate of the plating solution on the surface to be plated Wf-a becomes constant according to the up and down movement of the substrate holder 440 by the distance adjustment mechanism (the holder elevating mechanism) 442. This respect will be described below.

Figure 13:
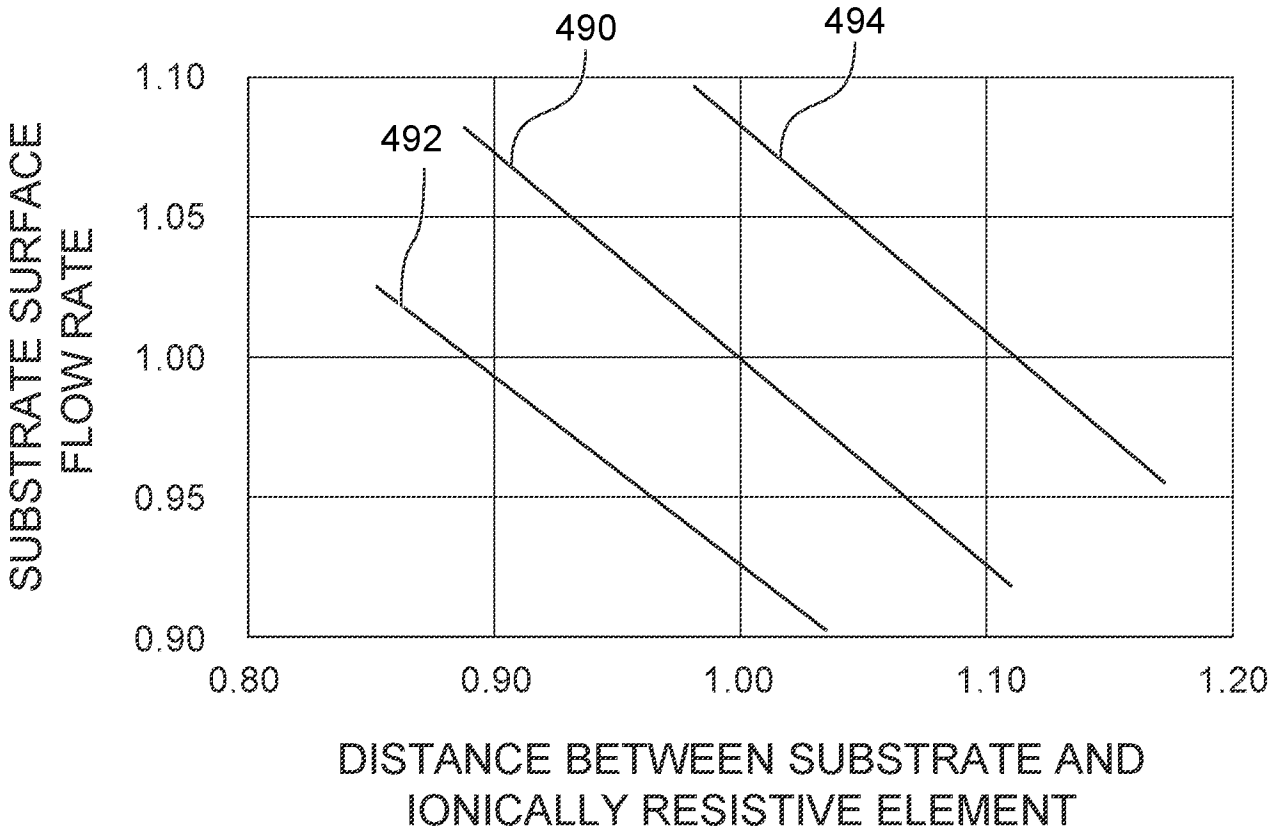
FIG. 13 is a drawing illustrating a flow rate of a plating solution on a surface to be plated when the distance between the substrate and the ionically resistive element is changed.

FIG. 13 is a drawing illustrating flow rates of the plating solution on the surface to be plated by each stirring speed of the paddle when the distance between the substrate and the ionically resistive element is changed. In FIG. 13, the vertical axis indicates the flow rate of the plating solution on the surface to be plated Wf-a and the horizontal axis indicates the distance between the substrate Wf and the ionically resistive element 450. In FIG. 13, a graph 490 indicates a flow rate of the plating solution on the surface to be plated Wf-a when the paddle 480 is stirred at a standard speed, a graph 492 indicates a flow rate of the plating solution on the surface to be plated Wf-a when the paddle 480 is stirred at a speed lower than the standard speed, and a graph 494 indicates a flow rate of the plating solution on the surface to be plated Wf-a when the paddle 480 is stirred at a speed higher than the standard speed.

As illustrated in FIG. 13, the paddle stirring mechanism 482 can maintain the flow rate of the plating solution on the surface to be plated Wf-a constant by adjusting the stirring speed of the paddle 480 at the high speed as indicated by the graph 494 when the distance between the substrate Wf and the ionically resistive element 450 increases while the paddle 480 is stirred at the standard speed as indicated by the graph 490. On the other hand, the paddle stirring mechanism 482 can maintain the flow rate of the plating solution on the surface to be plated Wf-a constant by adjusting the stirring speed of the paddle 480 at the low speed as indicated by the graph 492 when the distance between the substrate Wf and the ionically resistive element 450 decreases while the paddle 480 is stirred at the standard speed as indicated by the graph 490. As a result, with the plating module 400 of one embodiment, even when the height of the substrate holder 440 is changed during the plating process, the flow rate of the plating solution on the surface to be plated Wf-a can be maintained constant, thereby ensuring the improved uniformity of the plating film-thickness distribution.

Figure 14:
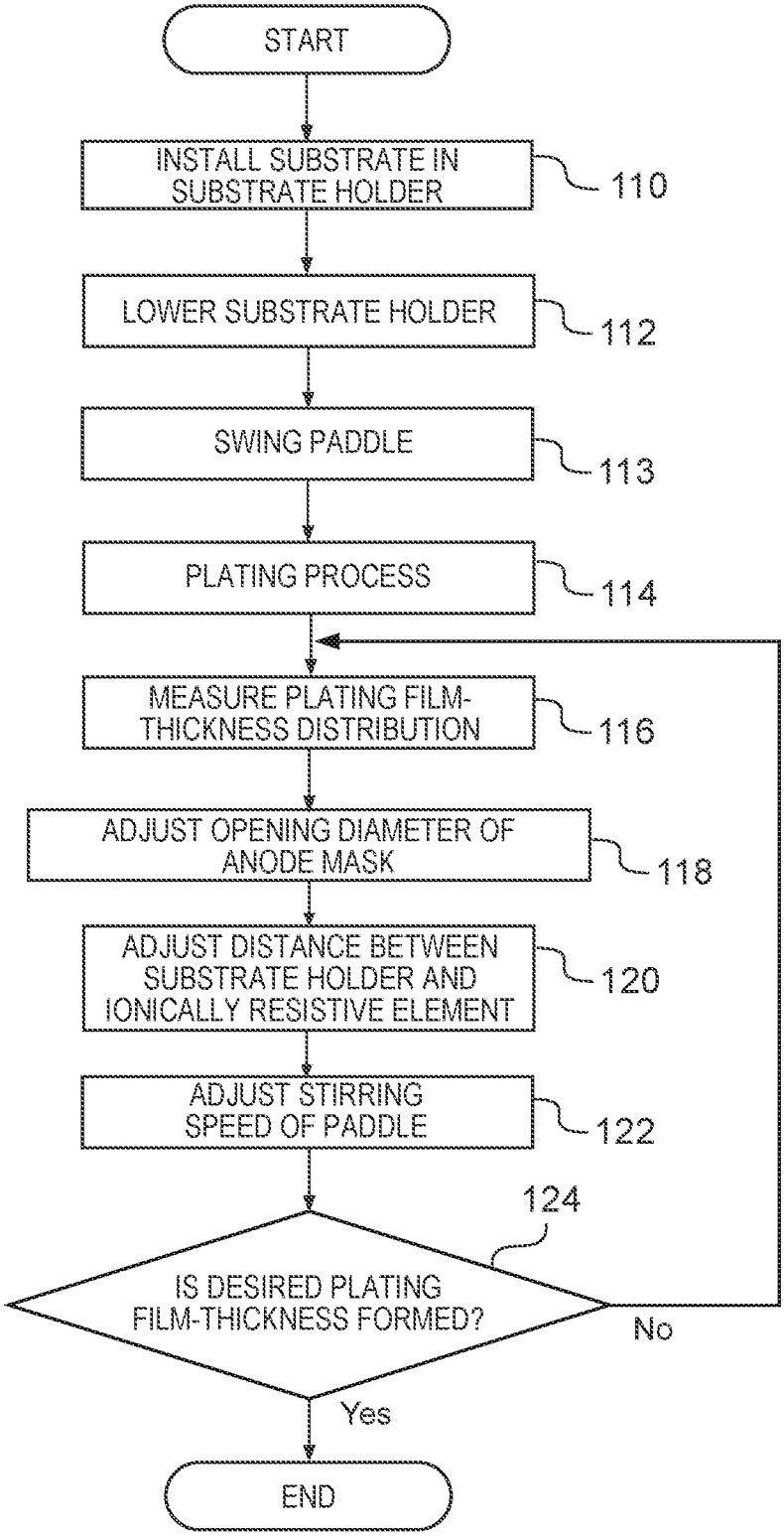
FIG. 14 is a flowchart illustrating a plating method of this embodiment.

Next, a plating method of this embodiment will be described. FIG. 14 is a flowchart illustrating the plating method of this embodiment. While the plating method described below is performed using the plating module 400 of the embodiment illustrated in FIG. 12, this should not be construed in a limiting sense, and may be performed using the plating module 400 of the embodiment illustrated in FIG. 3, FIG. 9, or FIG. 11. As illustrated in FIG. 14, the plating method, first, installs the substrate Wf with the surface to be plated Wf-a facing downward in the substrate holder 440 (an installation step 110). Subsequently, the plating method immerses the substrate Wf in the plating tank 410 by lowering the substrate holder 440 (an immersing step 112).

Subsequently, the plating method stirs the plating solution by swinging the paddle 480 in a parallel manner to the surface to be plated Wf-a of the substrate Wf using the paddle stirring mechanism 482 (A stirring step 113). Subsequently, the plating method forms a plating film on the surface to be plated Wf-a by applying a voltage between the anode 430 and the substrate Wf via the anode mask 460 and the ionically resistive element 450 (a plating step 114).

Subsequently, the plating method measures the plating film-thickness distribution or the current density distribution along the radial direction of the surface to be plated Wf-a by the sensor 470 during the plating step 114 (a measurement step 116). Subsequently, the plating method adjusts the size of the diameter of the opening 466 of the anode mask 460 based on the plating film-thickness distribution or the current density distribution measured in the measurement step 116 during the plating step 114 (an opening adjustment step 118). The opening adjustment step 118, specifically, adjusts the size of the diameter of the opening 466 of the anode mask 460 such that the difference in plating film-thickness or current density between the center portion Ct and the midpoint Md of the surface to be plated Wf-a measured in the measurement step 116 decreases.

Subsequently, the plating method adjusts the distance between the substrate holder 440 and the ionically resistive element 450 based on the plating film-thickness distribution or the current density distribution measured in the measurement step 116 during the plating step 114 (a distance adjustment step 120). The distance adjustment step 120, specifically, adjusts the distance between the substrate holder 440 and the ionically resistive element 450 such that the difference in plating film-thickness or current density between the midpoint Md and the outer circumference portion Eg of the surface to be plated Wf-a measured in the measurement step 116 decreases. The adjustment of the distance between the substrate holder 440 and the ionically resistive element 450 in the distance adjustment step 120 is performed by moving the substrate holder 440 up and down using the distance adjustment mechanism (the holder elevating mechanism) 442.

Subsequently, the plating method adjusts the stirring speed of the paddle 480 according to the adjustment of the distance between the substrate holder 440 and the ionically resistive element 450 in the distance adjustment step 120 (a speed adjustment step 122). Specifically, the speed adjustment step 122 adjusts the stirring speed of the paddle 480 using the paddle stirring mechanism 482 such that the flow rate of the plating solution on the surface to be plated Wf-a becomes constant according to the adjustment of the distance between the substrate holder 440 and the ionically resistive element 450 in the distance adjustment step 120.

Subsequently, the plating method determines whether the plating film having a desired thickness is formed or not on the surface to be plated Wf-a based on the plating film-thickness distribution or current density distribution measured in the measurement step 116 (a determining step 124). The plating method returns to the measurement step 116 to continue the process when it is determined that the plating film having a desired thickness is not formed on the surface to be plated Wf-a (the determining step 124, No). On the other hand, the plating method terminates the process when it is determined that the plating film having a desired thickness is formed on the surface to be plated Wf-a (the determining step 124, Yes).

With the plating method of one embodiment, the diameter of the opening 466 of the anode mask 460 is adjusted and the distance between the substrate Wf and the ionically resistive element 450 is adjusted while performing the plating process, thereby ensuring the improved uniformity of the plating film-thickness distribution on the surface to be plated Wf-a of the substrate Wf. In addition, with the plating method in one embodiment, since the stirring speed of the paddle 480 is adjusted according to the up and down movement of the substrate holder 440 during the plating process, the flow rate of the plating solution on the surface to be plated Wf-a can be maintained constant, thereby ensuring the improved uniformity of the plating film-thickness distribution as a result.

Note that, when the plating method is performed using the plating module 400 in the embodiment illustrated in FIG. 3, the stirring step 113 and the speed adjustment step 122 are not performed. When the plating method is performed using the plating module 400 in the embodiment illustrated in FIG. 9, a paddle position adjustment step that adjusts (moves up and down) the position of the paddle 480 by the paddle position adjustment mechanism 484 in synchronization with the adjustment of the distance between the substrate holder 440 and the ionically resistive element 450 in the distance adjustment step 120 is performed, instead of the speed adjustment step 122. When the plating method is performed using the plating module 400 in the embodiment illustrated in FIG. 11, the distance between the substrate Wf and the paddle 480 is constant, and therefore, the speed adjustment step 122 is not performed.

While some embodiments of the present invention have been described above, the embodiments of the above-described invention are to facilitate understanding of the present invention, are not to limit the present invention. The present invention can be changed or improved without departing from the gist thereof, and of course, the equivalents are included in the present invention. It is possible to appropriately combine or omit respective components according to claims and description in a range in which at least a part of the above-described problems can be solved, or a range in which at least a part of the effects can be exhibited.

As one embodiment, this application discloses a plating apparatus including a plating tank, a substrate holder, an anode, an anode mask, and an ionically resistive element. The plating tank is for housing a plating solution. The substrate holder is for holding a substrate. The anode is housed within the plating tank. The anode mask is arranged between the substrate held by the substrate holder and the anode. The anode mask is provided with an opening in a center of the anode mask. The ionically resistive element is arranged at an interval from the anode mask between the substrate held by the substrate holder and the anode mask. The ionically resistive element is provided with a plurality of holes.

As one embodiment, this application discloses the plating apparatus in which the anode mask is configured such that a size of a diameter of the opening is adjustable.

As one embodiment, this application discloses the plating apparatus further including a sensor configured to measure a plating film-thickness distribution or a current density distribution along a radial direction of a surface to be plated of the substrate held by the substrate holder. The anode mask is configured to adjust the size of the diameter of the opening based on the plating film-thickness distribution or the current density distribution measured by the sensor.

As one embodiment, this application discloses the plating apparatus further including a distance adjustment mechanism for adjusting a distance between the substrate holder and the ionically resistive element.

As one embodiment, this application discloses the plating apparatus further including a sensor configured to measure a plating film-thickness distribution or a current density distribution along a radial direction of a surface to be plated of the substrate held by the substrate holder. The distance adjustment mechanism is configured to adjust a distance between the substrate holder and the ionically resistive element based on the plating film-thickness distribution or the current density distribution measured by the sensor.

As one embodiment, this application discloses the plating apparatus further including a paddle arranged between the substrate held by the substrate holder and the ionically resistive element. The paddle is secured to the substrate holder.

As one embodiment, this application discloses the plating apparatus further including a paddle and a paddle position adjustment mechanism. The paddle is arranged between the substrate held by the substrate holder and the ionically resistive element. The paddle position adjustment mechanism is for adjusting a position of the paddle. The paddle position adjustment mechanism is configured to adjust the position of the paddle in synchronization with a position adjustment of the substrate holder by the distance adjustment mechanism.

As one embodiment, this application discloses the plating apparatus further including a paddle and a paddle stirring mechanism. The paddle is arranged between the substrate held by the substrate holder and the ionically resistive element. The paddle stirring mechanism is for stirring the paddle in the plating solution. The paddle stirring mechanism is configured to adjust a stirring speed of the paddle according to a position adjustment of the substrate holder by the distance adjustment mechanism.

As one embodiment, this application discloses the plating apparatus in which the ionically resistive element is a punching plate provided with a plurality of holes passing through a side of the substrate and a side of the anode or a porous body provided with a plurality of pores.

As one embodiment, this application discloses the plating apparatus further including a membrane configured to divide an inside of the plating tank into a cathode region in which the substrate is immersed and an anode region in which the anode is arranged. The anode mask is arranged in the anode region. The ionically resistive element is arranged in the cathode region.

As one embodiment, this application discloses a plating method including an installation step of installing a substrate in a substrate holder, an immersing step of immersing the substrate in a plating tank in which a plating solution is housed by adjusting a position of the substrate holder, and a plating step of forming a plating film on a surface to be plated of the substrate by applying a voltage between an anode and the substrate via an anode mask and an ionically resistive element. The anode mask is arranged between the anode housed within the plating tank and the substrate immersed in the plating solution. The anode mask is provided with an opening in a center of the anode mask. The ionically resistive element is arranged at an interval from the anode mask between the anode mask and the substrate immersed in the plating solution. The ionically resistive element is provided with a plurality of holes.

As one embodiment, this application discloses the plating method further including a measurement step of measuring a plating film-thickness distribution or a current density distribution along a radial direction of the surface to be plated of the substrate by a sensor during the plating step, and an opening adjustment step of adjusting a size of a diameter of the opening of the anode mask based on the plating film-thickness distribution or the current density distribution measured in the measurement step during the plating step.

As one embodiment, this application discloses the plating method in which the opening adjustment step is configured to adjust the size of the diameter of the opening of the anode mask such that a difference in plating film-thickness or current density between a center portion on the surface to be plated and a midpoint between the center portion and an outer circumference portion on the surface to be plated measured in the measurement step is decreased.

As one embodiment, this application discloses the plating method further including a distance adjustment step of adjusting a distance between the substrate holder and the ionically resistive element based on the plating film-thickness distribution or the current density distribution measured in the measurement step during the plating step.

As one embodiment, this application discloses the plating method in which the distance adjustment step is configured to adjust a distance between the substrate holder and the ionically resistive element such that a difference in plating film-thickness or current density between a midpoint between a center portion and an outer circumference portion on the surface to be plated and the outer circumference portion on the surface to be plated measured in the measurement step is decreased.

As one embodiment, this application discloses the plating method further including a stirring step of stirring the plating solution by swinging a paddle arranged between the substrate immersed in the plating solution and the ionically resistive element. The paddle is secured to the substrate holder.

As one embodiment, this application discloses the plating method further including a stirring step of stirring the plating solution by swinging a paddle arranged between the substrate immersed in the plating solution and the ionically resistive element, and a paddle position adjustment step of adjusting a position of the paddle in synchronization with an adjustment of the distance between the substrate holder and the ionically resistive element in the distance adjustment step.

As one embodiment, this application discloses the plating method further including a stirring step of stirring the plating solution by swinging a paddle arranged between the substrate immersed in the plating solution and the ionically resistive element, and a speed adjustment step of adjusting a stirring speed of the paddle according to an adjustment of the distance between the substrate holder and the ionically resistive element in the distance adjustment step.

REFERENCE SIGNS LIST

400 . . . plating module
410 . . . plating tank
430 . . . anode
440 . . . substrate holder
442 . . . distance adjustment mechanism
450 . . . ionically resistive element
452 . . . through-hole
460 . . . anode mask
466 . . . opening
470 . . . sensor
480 . . . paddle
482 . . . paddle stirring mechanism
484 . . . paddle position adjustment mechanism
1000 . . . plating apparatus
Ct . . . center portion
Eg . . . outer circumference portion
Md . . . midpoint
Wf . . . substrate
Wf-a . . . surface to be plated

The invention claimed is:

1. A plating apparatus comprising:
a plating tank for housing a plating solution;
a substrate holder for holding a substrate;
an anode housed within the plating tank;
an anode mask arranged between the substrate held by the substrate holder and the anode, the anode mask being provided with an opening in a center of the anode mask, the anode mask configured such that a size of a diameter of the opening is adjustable;
an ionically resistive element arranged at an interval from the anode mask between the substrate held by the substrate holder and the anode mask, the ionically resistive element being provided with a plurality of holes,
a sensor configured to measure a plating film-thickness distribution or a current density distribution along a radial direction of a surface to be plated of the substrate held by the substrate holder, wherein the anode mask is configured to adjust the size of the diameter of the opening based on the plating film-thickness distribution or the current density distribution measured by the sensor, and
a paddle arranged between the substrate held by the substrate holder and the ionically resistive element, wherein the paddle is secured to the substrate holder.

2. The plating apparatus according to claim 1, further comprising
a distance adjustment mechanism for adjusting a distance between the substrate holder and the ionically resistive element.

3. A plating apparatus comprising:
a plating tank for housing a plating solution;
a substrate holder for holding a substrate;
an anode housed within the plating tank;
an anode mask arranged between the substrate held by the substrate holder and the anode, the anode mask being provided with an opening in a center of the anode mask;
an ionically resistive element arranged at an interval from the anode mask between the substrate held by the substrate holder and the anode mask, the ionically resistive element being provided with a plurality of holes,
a distance adjustment mechanism for adjusting a distance between the substrate holder and the ionically resistive element,
a paddle arranged between the substrate held by the substrate holder and the ionically resistive element; and
a paddle position adjustment mechanism for adjusting a position of the paddle, wherein
the paddle position adjustment mechanism is configured to adjust the position of the paddle in synchronization with a position adjustment of the substrate holder by the distance adjustment mechanism.

* * * * *